US011180837B2

(12) United States Patent
Toda et al.

(10) Patent No.: US 11,180,837 B2
(45) **Date of Patent: *Nov. 23, 2021**

(54) HOT STAMPED ARTICLE

(71) Applicant: NIPPON STEEL CORPORATION, Tokyo (JP)

(72) Inventors: Yuri Toda, Tokyo (JP); Kazuo Hikida, Tokyo (JP); Shingo Fujinaka, Tokyo (JP); Tomohito Tanaka, Tokyo (JP)

(73) Assignee: NIPPOS STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/042,476

(22) PCT Filed: Mar. 29, 2018

(86) PCT No.: PCT/JP2018/013369

§ 371 (c)(1),
(2) Date: Sep. 28, 2020

(87) PCT Pub. No.: WO2019/186930

PCT Pub. Date: Oct. 3, 2019

(65) Prior Publication Data

US 2021/0010118 A1 Jan. 14, 2021

(51) Int. Cl.

| | |
|---|---|
| ***B32B 15/00*** | (2006.01) |
| ***C22C 38/58*** | (2006.01) |
| ***C21D 1/18*** | (2006.01) |
| ***C21D 9/46*** | (2006.01) |
| ***C22C 38/02*** | (2006.01) |
| ***C22C 38/44*** | (2006.01) |
| ***C22C 38/48*** | (2006.01) |

(52) U.S. Cl.

CPC ..... *C22C 38/58* (2013.01); *C21D 1/18* (2013.01); *C21D 9/46* (2013.01); *C22C 38/02* (2013.01); *C22C 38/44* (2013.01); *C22C 38/48* (2013.01); *Y10T 428/12799* (2015.01)

(58) Field of Classification Search

None

See application file for complete search history.

(56) References Cited

U.S. PATENT DOCUMENTS

| | | | | |
|---|---|---|---|---|
| 2013/0292009 | A1* | 11/2013 | Hayashi | C22C 38/04 148/518 |
| 2013/0295402 | A1* | 11/2013 | Oh | C21D 1/18 428/551 |
| 2017/0096724 | A1 | 4/2017 | Hikida et al. | |
| 2018/0023162 | A1* | 1/2018 | Sugiura | C21D 6/008 420/83 |
| 2018/0044748 | A1* | 2/2018 | Takagi | C21D 8/10 |
| 2018/0044749 | A1* | 2/2018 | Shuto | C21D 6/008 |
| 2019/0003004 | A1* | 1/2019 | Cho | C22C 38/44 |
| 2019/0382864 | A1* | 12/2019 | Cho | C21D 1/18 |

FOREIGN PATENT DOCUMENTS

| | | | |
|---|---|---|---|
| JP | 2002-309345 | A | 10/2002 |
| JP | 5114691 | B2 | 1/2013 |
| JP | 5369714 | B2 | 12/2013 |
| JP | 2014-15638 | A | 1/2014 |
| WO | WO 2015/147216 | A1 | 10/2015 |

* cited by examiner

*Primary Examiner* — Seth Dumbris

(74) *Attorney, Agent, or Firm* — Birch, Stewart, Kolasch & Birch, LLP

(57) ABSTRACT

A hot stamped article of high strength steel sheet excellent in bending deformability having a predetermined chemical composition, having an area rate of 90% or more of the microstructures of the steel sheet comprised of one or more of lower bainite, martensite, and tempered martensite, and having a ratio of the length of grain boundaries with a rotational angle about a rotational axis of the <011> direction of the crystal grains of the lower bainite, martensite, and tempered martensite of 15° or more with respect to the length of grain boundaries with a rotational angle of 5° to 75° of 80% or more.

2 Claims, No Drawings

HOT STAMPED ARTICLE

FIELD

The present invention relates to a hot stamped article having particularly excellent bending deformability used for structural members or reinforcing members of automobiles or structures where strength is required.

BACKGROUND

In recent years, from the viewpoints of environmental protection and resource saving, lighter weight of automobile bodies is being sought. For this reason, application of high strength steel sheet to automobile members has been accelerating. However, along with the increase in strength of steel sheets, the formability deteriorates, so in high strength steel sheets, formability into members with complicated shapes is a problem.

To solve this problem, hot stamping, where the steel sheet is heated to a high temperature of the austenite region, then press formed, is increasingly being applied. Hot stamping performs press forming and simultaneously quenching in the die, so is being taken note of as a technique achieving both formation of a material into an automobile member and securing of strength.

On the other hand, a shaped part obtained by hot stamping high strength steel sheet requires performance absorbing shock at the time of collision (portion inhibiting deformation at collision). For this reason, a high shock absorption (bending deformability) is required.

PTL 1 discloses as art meeting this demand to anneal a steel sheet for hot stamping use and concentrate the Mn or Cr in carbides to make the carbides difficult to dissolve and thereby suppress the growth of and refine the austenite by these carbides at the time of heating for hot stamping.

PTL 2 discloses the art of raising the temperature by a 90° C./s or less heating rate at the time of hot stamping to thereby refine the austenite.

PTL 3, PTL 4, and PTL 5 also disclose the art of refining the austenite to improve the toughness.

CITATIONS LIST

Patent Literature

[PTL 1] WO 2015/147216
[PTL 2] Japanese Patent No. 5369714
[PTL 3] Japanese Patent No. 5114691
[PTL 4] Japanese Unexamined Patent Publication No. 2014-15638
[PTL 5] Japanese Unexamined Patent Publication No. 2002-309345

SUMMARY

Technical Problem

However, in the arts disclosed in the above PTLs 1 to 5, it is difficult to obtain further refined austenite and no strength or bending deformability greater than in the past can be expected.

The present invention, in consideration of the technical issue in the prior art, has as its technical issue securing a more excellent bending deformability in a hot stamped article of high strength steel sheet and has as its object the provision of a hot stamped article solving the technical issue.

Solution to Problem

The inventors engaged in an in-depth study of a method for solving the above technical issue. As a result, they discovered that if making the ratio of grain boundaries with a rotational angle about a rotational axis of the <011> direction of the crystal grains of lower bainite, martensite, and tempered martensite of 15 or more in a hot stamped article in the grain boundaries with a rotational angle of 5° to 75° a value of 80% or more, excellent bending deformability is obtained.

The present invention was made after further study based on the above discovery and has as its gist the following:

(1) A hot stamped article, having a chemical composition comprising, by mass %, C: 0.35% to 0.75%, Si: 0.005% to 0.25%, Mn: 0.5% to 3.0%, sol. Al: 0.0002% to 3.0%, Cr: 0.05% to 1.00%, B: 0.0005% to 0.010%, Nb: 0.01% to 0.15%, Mo: 0.005% to 1.00%, Ti: 0% to 0.15%, Ni: 0% to 3.00%, P: 0.10% or less, S: 0.10% or less, N: 0.010% or less, and a balance of Fe and unavoidable impurities, microstructures in which at least one of lower bainite, martensite, and tempered martensite are contained with an area rate of 90% or more, and when the <011> direction of the crystal grains of the lower bainite, martensite, and tempered martensite is a rotational axis, a ratio of a length of grain boundaries with a rotational angle 15° or more to a length of grain boundaries with a rotational angle of 5° to 75° is 80% or more.

(2) A hot stamped article of the above (1) having a plated layer.

Advantageous Effects of Invention

According to the present invention, it is possible to provide a hot stamped article having excellent bending deformability.

DESCRIPTION OF EMBODIMENTS

The present invention features making a ratio of grain boundaries with a rotational angle about a rotational axis of the <011> direction of the crystal grains of lower bainite or martensite or tempered martensite in a hot stamped article of 15° or more in grain boundaries with a rotational angle of 5° to 75° a value of 80% or more to thereby obtain excellent bending deformability. Making the structures of the hot stamped article such structures makes excellent bending deformability better because 15° or more high angle grain boundaries are more effective in suppressing propagation of cracks than less than 15° low angle grain boundaries. The inventors studied this in depth and as a result discovered that the above structures are obtained by the following method.

As a first stage, the amount of casting of the molten steel per unit time is controlled. Due to this, the precipitation of Mo and Nb is suppressed and the amounts of solid solution of the Mo and Nb in the steel are made to increase.

If controlling the amount of casting of the molten steel per unit time to reduce the precipitation of Mo, Nb, simultaneously the microsegregation of Mn is suppressed, so the trap sites of P are lost, therefore at the time of finish rolling, P segregates at the prior austenite grain boundaries. This being so, the brittle strength of the grain boundaries falls, so even if controlling the crystal orientation, bending deformability cannot be sufficiently obtained. This is because Mn and P are high in affinity, so segregation of Mn functions to create sites for trapping P and elimination of segregation of Mn results in P dispersing to the prior austenite grain boundaries. In the present invention, this problem is resolved by the control of the rolling conditions.

As a second stage, the rolling reduction and temperature of the hot finish rolling and the cooling conditions after rolling are controlled to suppress concentration of Mn or Cr in the carbides. To make the crystal grain boundaries of the lower bainite, martensite, and tempered martensite preferential sites for reverse transformation of austenite, the carbides are preferably made easily dissolvable. For this reason, it is important to not allow Mn, Cr, and other elements obstructing dissolution of carbides to concentrate at the carbides.

Further, by keeping the Mo, Nb from precipitating and making the Nb and Mo form solid solutions at the grain boundaries of the prior austenite, the sites for segregation of P are occupied by Nb and Mo and the segregation of P at the prior austenite is eliminated. Due to this, it is possible to not only improve the grain boundary strength by Mo or Nb, but also keep down the reduction of the brittle strength of the grain boundaries.

Furthermore, by controlling the coiling conditions, it is possible to raise the strength of the austenite by the effects of solid solution Mo and Nb. In addition, when transforming austenite to lower bainite, martensite, and tempered martensite in phase, a crystal orientation advantageous for easing the stress occurring due to the transformation is preferably formed. Due to this, in steel sheet for hot stamping use, it is possible to control the X-ray random intensity ratio of the {112}<111> of the crystal grains of lower bainite, martensite, and tempered martensite.

By supplying steel sheet for hot stamping use having such features to the hot stamping step, due to the texture memory effect of austenite and martensite, the ratio of the grain boundaries with a rotational angle about a rotational axis of the <011> direction of the crystal grains of lower bainite, martensite, and tempered martensite in a hot stamped article of 15° or more in grain boundaries with a rotational angle of 5° to 75° is made 80% or more.

In the present invention, in the hot stamping step, by using crystal grain boundaries of lower bainite, martensite, and tempered martensite as sites for reverse transformation of austenite, it is possible to continue control of the crystal orientation expressed in the steel sheet for hot stamping use at the hot stamped article.

Below, the hot stamped article of the present invention and the method for manufacturing the same will be explained.

First, the reasons for limitation of the composition forming the hot stamped article of the present invention will be explained. Below, the % according to the composition means the mass %.

"C: 0.35% to 0.75%"

C is an important element for obtaining a 2000 MPa or more tensile strength. With less than 0.35%, the martensite is soft and it is difficult to secure a 2000 MPa or more tensile strength, so C is made 0.35% or more, preferably 0.37% or more. In view of the balance of the demanded strength and suppression of early fracture, the upper limit is made 0.75%.

"Si: 0.005% to 0.25%"

Si is an element raising the deformation ability and contributing to improvement of the shock absorption. If less than 0.005%, the deformability is poor and the shock absorption deteriorates, so 0.005% or more is added, preferably 0.01% or more. On the other hand, if over 0.25%, the amount of formation of a solid solution in the carbides increases, the carbides become harder to dissolve, the remaining undissolved carbides end up becoming sites for reverse transformation of austenite, and the ratio of grain boundaries with a rotational angle about a rotational axis of the <011> direction of the crystal grains of lower bainite or martensite or tempered martensite of 15° or more in the grain boundaries with a rotational angle of 5° to 75° can no longer be controlled to 80% or more. Therefore, the upper limit is made 0.25%. Preferably the content is 0.22% or less.

"Mn: 0.5% to 3.0%"

Mn is an element contributing to improvement of strength by solution strengthening. If less than 0.5%, the solution strengthening ability is poor, the martensite becomes softer, and securing a 2000 MPa or more tensile strength is difficult, so 0.5% or more is added, preferably 0.7% or more. On the other hand, if adding over 3.0%, the amount of formation of a solid solution in the carbides increases, the carbides become harder to dissolve, the remaining undissolved carbides end up becoming sites for reverse transformation of austenite, and the ratio of grain boundaries with a rotational angle about a rotational axis of the <011> direction of the crystal grains of lower bainite or martensite or tempered martensite of 15° or more in the grain boundaries with a rotational angle of 5° to 75° can no longer be controlled to 80% or more. Therefore, the upper limit is made 3.0%. Preferably the content is 2.5% or less.

"Sol. Al: 0.0002% to 3.0%"

Al is an element acting to deoxidize the molten steel and make the steel sounder. With less than 0.0002%, the deoxidation is sufficient, coarse oxides are formed, and early fracture is caused, so sol. Al is made 0.0002% or more. Preferably the content is 0.0010% or more. On the other hand, even if adding over 3.0%, coarse oxides are formed and early fracture is caused, so the content is made 3.0% or less, preferably 2.5% or less, more preferably 0.5% or less.

"Cr: 0.05% to 1.00%"

Cr is an element contributing to improvement of strength by solution strengthening. If less than 0.05%, the solution strengthening ability is poor, the martensite becomes soft, and a 2000 MPa or more tensile strength is difficult to secure, so 0.05% or more is added, preferably 0.1% or more. On the other hand, if adding over 1.00%, the amount of formation of a solid solution in the carbides increases, the carbides become harder to dissolve, the remaining undissolved carbides end up becoming sites for reverse transformation of austenite, and the ratio of grain boundaries with a rotational angle about a rotational axis of the <011> direction of the crystal grains of lower bainite or martensite or tempered martensite of 15° or more in the grain boundaries with a rotational angle of 5° to 75° can no longer be controlled to 80% or more. Therefore, the upper limit is made 1.00%. Preferably the content is 0.8% or less.

"B: 0.0005% to 0.010%"

B is an element contributing to improvement of strength by solution strengthening. If less than 0.0005%, the solution strengthening ability is poor, the martensite becomes soft, and a 2000 MPa or more tensile strength is difficult to secure, so 0.0005% or more is added, preferably 0.0008% or more. On the other hand, if adding over 0.010%, the amount of formation of a solid solution in the carbides increases, the carbides become harder to dissolve, the remaining undissolved carbides end up becoming sites for reverse transformation of austenite, and the ratio of grain boundaries with a rotational angle about a rotational axis of the <011> direction of the crystal grains of lower bainite or martensite or tempered martensite of 15° or more in the grain boundaries with a rotational angle of 5° to 75° can no longer be controlled to 80% or more. Therefore, the upper limit is made 0.010%. Preferably the content is 0.007% or less.

"Nb: 0.01% to 0.15%"

Nb is an element forming a solid solution at the grain boundaries of the prior austenite to raise the strength of the grain boundaries. Further, Nb obstructs the grain boundary segregation of P by forming a solid solution at the grain boundaries, so improves the brittle strength of the grain boundaries. For this reason, 0.01% or more is added, preferably 0.030% or more. On the other hand, if adding over 0.15%, it easily precipitates as carbides, the X-ray random intensity ratio of {112}<111> of crystal grains of lower bainite, martensite, or tempered martensite in the steel sheet for hot stamping use cannot be made 2.8 or more, and as a result, the ratio of grain boundaries with a rotational angle about a rotational axis of the <011> direction of the crystal grains of lower bainite, martensite, or tempered martensite of 15° or more in the grain boundaries with a rotational angle of 5° to 75° can no longer be controlled to 80% or more. Therefore, the upper limit is made 0.15%. Preferably the content is 0.12% or less.

"Mo: 0.005% to 1.00%"

Mo is an element forming a solid solution at the grain boundaries of the prior austenite to raise the strength of the grain boundaries. Further, Mo obstructs the grain boundary segregation of P by forming a solid solution at the grain boundaries, so improves the brittle strength of the grain boundaries. For this reason, 0.005% or more is added, preferably 0.030% or more. On the other hand, if adding over 1.00%, it easily precipitates as carbides, the X-ray random intensity ratio of {112}<111> of crystal grains of lower bainite, martensite, or tempered martensite in the steel sheet for hot stamping use cannot be made 2.8 or more, and as a result, the ratio of grain boundaries with a rotational angle about a rotational axis of the <011> direction of the crystal grains of lower bainite, martensite, or tempered martensite of 15° or more in the grain boundaries with a rotational angle of 5° to 75° can no longer be controlled to 80% or more. Therefore, the content is made 1.00% or less, preferably 0.80% or less.

"Ti: 0% to 0.15%"

Ti is not an essential element, but is an element contributing to improvement of strength by solution strengthening, so may be added as needed. When adding Ti, to obtain the effect of addition, the content is preferably made 0.01% or more, more preferably 0.02% or more. On the other hand, if adding over 0.15%, coarse carbides and nitrides are formed and early fracture is caused, so the content is made 0.15% or less, preferably 0.12% or less.

"Ni: 0% to 3.00%"

Ni is not an essential element, but is an element contributing to improvement of strength by solution strengthening, so may be added as needed. When adding Ni, to obtain the effect of addition, the content is preferably made 0.01% or more, more preferably 0.02% or more. On the other hand, even if added in over 3.00%, the steel becomes brittle and early fracture is caused, so the content is made 3.00% or less, preferably 2.00% or less.

"P: 0.10% or Less"

P is an impurity and is an element easily segregating at the grain boundaries and lowering the brittle strength of the grain boundaries. If over 0.10%, the brittle strength of the grain boundaries remarkably falls and early fracture is caused, so P is made 0.10% or less, preferably 0.050% or less. The lower limit is not particularly prescribed, but if reducing this to less than 0.0001%, the dephosphorization cost greatly rises and the result becomes economically disadvantageous, so in practical steel sheet, 0.0001% is the substantive lower limit.

"S: 0.10% or Less"

S is an impurity element and is an element which forms inclusions. If over 0.10%, inclusions are formed and cause early fracture, so S is made 0.10% or less, preferably 0.0050% or less. The lower limit is not particularly prescribed, but if reducing the content to less than 0.0015%, the desulfurization cost greatly rises and the result becomes economically disadvantageous, so in practical steel sheet, 0.0015% is the substantive lower limit.

"N: 0.010% or Less"

N is an impurity element and is an element which forms nitrides and causes early fracture, so is made 0.010% or less, preferably 0.0075% or less. The lower limit is not particularly prescribed, but if reducing the content to less than 0.0001%, the denitridation cost greatly rises and the result becomes economically disadvantageous, so in practical steel sheet, 0.0001% is the substantive lower limit.

The balance of the composition is Fe and impurities. As impurities, elements which unavoidably enter from the steel raw materials or scrap and/or manufacturing process and which are allowed to an extent not obstructing the properties of the hot stamped article of the present invention may be illustrated.

Next, the reasons for limitation of the microstructures of the hot stamped article of the present invention will be explained.

"Making Ratio of Grain Boundaries with Rotational Angle about Rotational Axis of <011> Direction of Crystal Grains of Lower Bainite, Martensite, and Tempered Martensite of 15° or More in Hot Stamped Article in Grain Boundaries with Rotational Angle of 5° to 75° a Value of 80% or More"

Control of the orientation of the crystal grains of the lower bainite, martensite, and tempered martensite is a structural factor important for securing excellent bending deformability. According to studies of the inventors, to obtain the shock absorption demanded from the hot stamped article, the more the ratio of grain boundaries with a rotational angle about a rotational axis of the <011> direction of the crystal grains of the lower bainite, martensite, and tempered martensite of 15° or more in the grain boundaries with a rotational angle of 5° to 75° is made to increase, the better. The ratio must be controlled to 80% or more, more preferably 85% or more.

The ratio of grain boundaries with a rotational angle about a rotational axis of the <011> direction of the crystal grains of the lower bainite or martensite or tempered martensite of 15° or more in the grain boundaries with a rotational angle of 5° to 75° is measured as follows:

A sample is cut out from the center of the hot stamped article so as to enable observation of cross-section vertical to the sheet surface (sheet thickness cross-section). #600 to #1500 silicon carbide paper is used to polish the measurement surface, then a solution of particle size 1 μm to 6 μm diamond powder dispersed in alcohol or another diluent or pure water is used to finish the sample to a mirror surface.

Next, a standard colloidal silica suspension (particle size 0.04 μm) is used for finishing polishing for 8 to 20 minutes.

The polished sample is washed by acetone or ethyl alcohol, then dried and set in a scanning electron microscope. The scanning electron microscope used is a model equipped with an EBSD detector (DVC5 type detector made by TSL).

At a sheet thickness ⅜ position to a ⅝ position of the sample, a range of 50 μm in the sheet thickness direction and 50 μm in the rolling direction is measured by EBSD at 0.1 μm measurement intervals to obtain crystal orientation information. The measurement conditions are made a vacuum level of $9.6\times10^{-5}$ or less, an acceleration voltage of 15 kV, an irradiation current of 13 nA, a Binning size of 4×4, and an exposure time of 42 seconds.

Using the "Inverse Pole Figure Map" and "Axis Angle" function included in the software "OIM Analysis®" attached to the EBSD analysis apparatus, the length of the grain boundaries with a rotational angle of 5° to 75° about a rotational axis of the <011> direction in the grain boundaries of the crystal grains having a body-centered cubic structure was calculated from the measurement data.

Next, the length of the grain boundaries with a rotational angle of 15° to 75° about a rotational axis of the <011> direction was calculated and divided by the length of the grain boundaries with a rotational angle of 5° to 75° about a rotational axis of the <011> direction.

The above measurement is performed at least at five locations. The average value is made the ratio of the grains with a rotational angle about a rotational axis of the <011> direction of the crystal grains of lower bainite, martensite, or tempered martensite of 15° or more in the grain boundaries with a rotational angle of 5° to 75°.

"Area Rate of 90% or More of Microstructures Comprised of at Least One of Lower Bainite, Martensite, and Tempered Martensite"

In order for the hot stamped article to be given a 1500 MPa or more tensile strength, the microstructures have to contain an area rate of 90% or more of martensite or tempered martensite, preferably 94% or more. From the viewpoint of securing the tensile strength, the microstructures may be lower bainite. An area rate of 90% or more of the structures may be comprised of any one of lower bainite, martensite, and tempered martensite or mixed structures of the same.

The balance of the microstructures is not particularly limited. For example, upper bainite, residual austenite, and pearlite may be mentioned.

The area rates of the lower bainite, martensite, and tempered martensite are measured as follows:

A cross-section vertical to the sheet surface is cut out from the center of the hot stamped article. #600 to #1500 silicon carbide paper is used to polish the measurement surface, then a solution of particle size 1 μm to 6 μm diamond powder dispersed in alcohol or another diluent or pure water is used to finish the sample to a mirror surface.

The sample is immersed in a 1.5 to 3% nitric acid-alcohol solution for 5 to 10 seconds to expose the high angle grain boundaries. At that time, the corrosion work is performed in an exhaust treatment apparatus. The temperature of the work atmosphere is made ordinary temperature.

The corroded sample is washed by acetone or ethyl alcohol, then dried and supplied to a scanning electron microscope for examination. The scanning electron microscope used is made one provided with a secondary electron detector. The sample is irradiated by electron beams in a $9.6\times10^{-5}$ or less vacuum at an acceleration voltage of 10 kV at level 8 of irradiation current to capture secondary electron images in the range of the ⅛ to ⅜ position about the sheet thickness ¼ position of the sample. The number of captured fields of a capture magnification of 10000× based on a horizontal 386 mm×vertical 290 mm screen is made 10 fields or more.

In the captured secondary images, the crystal grain boundaries and carbides are captured as bright contrast, so the positions of the crystal grain boundaries and carbides can be used to simply judge the structures. If carbides are formed inside the crystal grains, the structures are tempered martensite or lower bainite. If no carbides are observed inside the crystal grains, the structures are martensite.

On the other hand, the structures which the carbides form at the crystal grain boundaries are upper bainite or pearlite.

Residual austenite differs in crystal structure from the above microstructures, so a field the same as the position capturing the secondary electron image is measured by the electron backscatter diffraction method. The scanning electron microscope used is made one provided with a camera in which the electron backscatter diffraction method is possible. The sample is irradiated by electron beams in a $9.6\times10^{-5}$ or less vacuum at an acceleration voltage of 25 kV at level 16 of irradiation current for measurement. A map of a face-centered cubic lattice is prepared from the obtained measurement data.

The capture magnification is made 10000× based on a horizontal 386 mm×vertical 290 mm screen. A mesh of 2 μm intervals is prepared on the captured photograph and the microstructures at the intersecting points of the mesh are determined. The value of the number of intersecting points of each structure divided by all intersecting points is made the area fraction of that microstructure. This operation is performed for 10 fields and the average value is calculated for use as the area ratio of the microstructure.

"Method for Manufacturing Steel Sheet for Hot Stamping Use"

Next, embodiments of the hot stamped article according to the present invention and the method for manufacture for obtaining the steel sheet for hot stamping use used for manufacture of the hot stamped article will be explained, but the present invention is not limited to the embodiments explained below.

Method for Manufacturing Steel Sheet for Hot Stamping Use (1) Continuous Casting Step Molten steel having the above-mentioned composition is made into a steel slab by the continuous casting method. In this continuous casting step, the amount of casting of molten steel per unit time is preferably made 6 ton/min or less. If the amount of casting of molten steel per unit time (casting rate) at the time of continuous casting is over 6 tons/min, microsegregation of Mn increases and the amount of nucleation of the precipitates mainly comprised of Mo and Nb ends up increasing. The amount of casting is more preferably made 5 ton/min or less. The lower limit of the amount of casting is not particularly limited, but from the viewpoint of the operating cost, the amount is preferably 0.1 ton/min or more.

(2) Hot Rolling Step

The above-mentioned steel slab is hot rolled to obtain a steel sheet. At that time, the hot rolling is ended in the A3 transformation temperature defined by formula (2)+10° C. to the A3 transformation temperature+200° C. in temperature region, the final rolling reduction at that time is made 12% or more, the cooling is started within 1 second after the end of finish rolling, the cooling is performed from the final rolling end temperature down to 550° C. in temperature region by a 100° C./s or more cooling rate, and the sheet is coiled at less than 500° C. in temperature.

$$\text{A3 transformation temperature}=850+10\times(C+N)\times Mn+350\times Nb+250\times Ti+40\times B+10\times Cr+100\times Mo \quad \text{formula (2)}$$

By making the finish rolling temperature the A3 transformation temperature+10° C. or more, recrystallization of austenite is promoted. Due to this, formation of low angle grain boundaries in the crystal grains is suppressed and the sites for precipitation of Nb, Mo can be decreased. Further, by decreasing the sites for precipitation of Nb, Mo, the consumption of C can be suppressed, so in the later steps, it is possible to increase the number density of the carbides. Preferably, the temperature is made the A3 transformation temperature+30° C. or more.

By making the finish rolling temperature the A3 transformation temperature+200° C. or less, excessive grain growth of austenite is suppressed. By finish rolling at the A3 transformation temperature+200° C. or less in temperature region, recrystallization of austenite is promoted and still further excessive grain growth does not occur, so in the coiling step, it is possible to obtain fine carbides. Preferably the temperature is made the A3 transformation temperature+150° C. or less.

By making the rolling reduction of the finish rolling 12% or more, recrystallization of austenite is promoted. Due to this, formation of low angle grain boundaries in the crystal grains is suppressed and the number of sites of precipitation of Nb, Mo can be reduced. Preferably, it is made 15% or more.

By starting the cooling within 1 second after the end of finish rolling, preferably within 0.8 second, and cooling from the temperature at the end of the finish rolling down to 550° C. in temperature region by a 100° C./s or more cooling rate, it is possible to reduce the dwelling time in the temperature region at which precipitation of Nb and Mn is promoted. As a result, it is possible to suppress the precipitation of Nb and Mo in the austenite and the amount of solid solution of Nb and Mo at the austenite grain boundaries increases.

By making the coiling temperature less than 500° C., the above effect is improved and it is possible to control the X-ray random intensity ratio of the {112}<111> of the crystal grains in the steel sheet for hot stamping use. Further, right after finish rolling, the Nb and Mo form solid solutions in the austenite. By causing transformation of the austenite in which Nb and Mo form solid solutions to lower bainite, martensite, or tempered martensite, the Nb, Mo are made to preferably form crystal orientations advantageous for relieving the stress occurring due to transformation, so it is possible to control the X-ray random intensity ratio of {112}<111> of the crystal grains. Therefore, the temperature is preferably less than 480° C. The lower limit is not particularly prescribed, but coiling at room temperature or less is difficult in actual operation, so room temperature becomes the lower limit.

(3) Formation of Plated Layer

The surface of the softened layer may be formed with a plated layer for the purpose of improving the corrosion resistance etc. The plated layer may be either an electroplated layer and hot dip coated layer. As the electroplated layer, an electrogalvanized layer, electric Zn—Ni alloy plated layer, etc. may be illustrated. As the hot dip coated layer, a hot dip galvanized layer, hot dip galvannealed layer, hot dip aluminum plated layer, hot dip Zn—Al alloy coated layer, hot dip Zn—Al—Mg alloy coated layer, hot dip Zn—Al—Mg—Si alloy coated layer, etc. may be illustrated. The amount of deposition of the plated layer is not particularly limited and may be a general amount of deposition.

(4) Other Steps

In the manufacture of steel sheets for hot stamping use, in addition, pickling, cold rolling, temper rolling, and other known processes may be included.

Manufacturing Step of Hot Stamped Article

The hot stamped article of the present invention is manufactured by heating a steel sheet for hot stamping use to 500° C. to the A3 point in temperature region by a less than 100° C./s average heating rate, holding it there, then hot stamping and shaping it, then cooling the shaped part down to room temperature.

Further, to adjust the strength, it is also possible to temper part of the regions or all of the regions of the hot stamped article at 200° C. to 500° C. in temperature.

By heating at 500° C. to the A3 point in temperature region by a less than 100° C./s average heating rate, the grain boundaries of the lower bainite, martensite, and tempered martensite formed in the steel sheet for hot stamping use function as sites for reverse transformation of austenite. Due to the texture memory effect of austenite and martensite, the ratio of the grain boundaries with a rotational angle about a rotational axis of the <011> direction of the crystal grains of lower bainite, martensite, or tempered martensite in a hot stamped article of 15° or more in grain boundaries with a rotational angle of 5° to 75° is made 80% or more.

If the average heating rate is 100° C./s or more, the fine carbides become sites for reverse transformation to austenite, so it is not possible to obtain the texture memory effect of austenite and martensite. Preferably, the rate is 90° C./s or less. The lower limit is not particularly prescribed, but if less than 0.01° C./s, the manufacturing cost becomes disadvantageous, so 0.01° C./s or more is preferable. More preferably, it is 1° C./s or more.

The holding temperature at the time of the hot stamping is preferably the A3 point+10° C. to the A3 point+150° C. so as to refine the prior austenite grains. Further, the cooling rate after hot stamping is preferably made 10° C./s or more from the viewpoint of improvement of the strength.

EXAMPLES

Next, examples of the present invention will be explained, but the conditions in the examples are illustrations of conditions employed for confirming the workability and effects of the present invention. The present invention is not limited to these illustrations of conditions. The present invention can employ various conditions so long as realizing the object of the present invention without departing from the gist of the present invention.

The steel slabs manufactured by casting molten steels of the compositions shown in Tables 1-1 to 1-3 were hot rolled and cold rolled as shown in Tables 2-1 to 2-3 to produce steel sheets for hot stamping use. The steel sheets for hot stamping use were heat treated as shown in Table 3-1 to 3-3 and hot stamped to manufacture parts.

Tables 3-1 to 3-3 show the results of evaluation of the microstructures and mechanical properties of the hot stamped articles.

TABLE 1-1

| Steel | Composition/mass % | | | | | | | | | | | | | A3 | |
|---|---|---|---|---|---|---|---|---|---|---|---|---|---|---|---|
| no. | C | Si | Mn | sol. Al | Cr | B | Nb | Mo | P | S | N | Ti | Ni | (° C.) | remarks |
| 1 | 0.28 | 0.05 | 1.1 | 0.040 | 1.00 | 0.0015 | 0.080 | 0.001 | 0.005 | 0.0020 | 0.0020 | 0.020 | | 876 | Comp. ex. |
| 2 | 0.32 | 0.22 | 1.6 | 0.045 | 0.05 | 0.0005 | 0.010 | 0.002 | 0.010 | 0.0040 | 0.0040 | | | 839 | Comp. ex. |
| 3 | 0.30 | 0.15 | 1.3 | 0.028 | 0.87 | 0.0015 | 0.015 | 0.210 | 0.007 | 0.0093 | 0.0024 | 0.015 | | 873 | Comp. ex. |
| 4 | 0.30 | 0.24 | 1.5 | 0.040 | 0.20 | 0.0050 | 0.080 | 0.001 | 0.011 | 0.0020 | 0.0041 | 0.050 | | 877 | Comp. ex. |
| 5 | 0.17 | 0.02 | 0.6 | 0.088 | 0.05 | 0.0013 | 0.020 | 0.001 | 0.068 | 0.0220 | 0.0019 | 0.010 | | 841 | Comp. ex. |
| 6 | 0.21 | 0.25 | 1.4 | 0.046 | 0.22 | 0.0021 | 0.015 | 0.018 | 0.015 | 0.0021 | 0.0033 | 0.025 | | 849 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 872 | Inv. ex. |
| 8 | 0.42 | 0.21 | 1.5 | 0.051 | 0.48 | 0.0023 | 0.084 | 0.012 | 0.012 | 0.0005 | 0.0032 | 0.029 | | 899 | Inv. ex. |
| 9 | 0.76 | 0.21 | 1.4 | 0.044 | 0.24 | 0.0021 | 0.048 | 0.011 | 0.012 | 0.0003 | 0.0036 | 0.030 | | 888 | Comp. ex. |
| 10 | 0.37 | 0.001 | 1.4 | 0.052 | 0.43 | 0.0025 | 0.088 | 0.011 | 0.015 | 0.0005 | 0.0029 | | | 871 | Comp. ex. |
| 11 | 0.36 | 0.008 | 1.4 | 0.047 | 0.44 | 0.0024 | 0.087 | 0.010 | 0.011 | 0.0004 | 0.0032 | | | 871 | Inv. ex. |
| 12 | 0.36 | 0.16 | 1.4 | 0.045 | 0.42 | 0.0024 | 0.086 | 0.011 | 0.013 | 0.0005 | 0.0032 | | | 871 | Inv. ex. |
| 13 | 0.38 | 0.22 | 1.5 | 0.046 | 0.43 | 0.0022 | 0.085 | 0.011 | 0.013 | 0.0005 | 0.0029 | | | 871 | Inv. ex. |
| 14 | 0.36 | 0.80 | 1.5 | 0.049 | 0.46 | 0.0024 | 0.086 | 0.011 | 0.014 | 0.0006 | 0.0030 | | | 871 | Comp. ex. |
| 15 | 0.38 | 0.20 | 0.3 | 0.044 | 0.50 | 0.0022 | 0.087 | 0.010 | 0.014 | 0.0006 | 0.0030 | | | 868 | Comp. ex. |
| 16 | 0.37 | 0.20 | 0.5 | 0.046 | 0.46 | 0.0022 | 0.087 | 0.013 | 0.013 | 0.0004 | 0.0032 | | | 868 | Inv. ex. |
| 17 | 0.37 | 0.18 | 1.3 | 0.050 | 0.43 | 0.0024 | 0.086 | 0.013 | 0.014 | 0.0005 | 0.0032 | | | 871 | Inv. ex. |
| 18 | 0.37 | 0.20 | 2.6 | 0.046 | 0.46 | 0.0024 | 0.086 | 0.011 | 0.011 | 0.0005 | 0.0032 | | | 876 | Inv. ex. |
| 19 | 0.36 | 0.18 | 3.6 | 0.048 | 0.42 | 0.0025 | 0.085 | 0.011 | 0.014 | 0.0004 | 0.0031 | | | 878 | Comp. ex. |
| 20 | 0.37 | 0.20 | 1.5 | 0.0001 | 0.46 | 0.0022 | 0.086 | 0.010 | 0.015 | 0.0005 | 0.0032 | | | 871 | Comp. ex. |
| 21 | 0.37 | 0.18 | 1.4 | 0.0008 | 0.45 | 0.0024 | 0.088 | 0.010 | 0.011 | 0.0005 | 0.0031 | | | 872 | Inv. ex. |
| 22 | 0.37 | 0.21 | 1.4 | 0.043 | 0.45 | 0.0023 | 0.086 | 0.013 | 0.013 | 0.0004 | 0.0032 | | | 871 | Inv. ex. |
| 23 | 0.38 | 0.18 | 1.5 | 2.8 | 0.43 | 0.0024 | 0.086 | 0.013 | 0.015 | 0.0003 | 0.0029 | | | 872 | Inv. ex. |
| 24 | 0.36 | 0.20 | 1.5 | 3.7 | 0.44 | 0.0022 | 0.088 | 0.011 | 0.014 | 0.0005 | 0.0031 | | | 872 | Comp. ex. |
| 25 | 0.38 | 0.21 | 1.5 | 0.052 | 0.03 | 0.0025 | 0.084 | 0.013 | 0.014 | 0.0003 | 0.0032 | | | 867 | Comp. ex. |
| 26 | 0.38 | 0.21 | 1.4 | 0.050 | 0.08 | 0.0024 | 0.086 | 0.010 | 0.013 | 0.0003 | 0.0029 | | | 867 | Inv. ex. |
| 27 | 0.36 | 0.19 | 1.5 | 0.046 | 0.41 | 0.0022 | 0.087 | 0.013 | 0.015 | 0.0006 | 0.0029 | | | 871 | Inv. ex. |
| 28 | 0.36 | 0.20 | 1.4 | 0.049 | 0.90 | 0.0024 | 0.088 | 0.013 | 0.015 | 0.0006 | 0.0029 | | | 876 | Inv. ex. |
| 29 | 0.38 | 0.20 | 1.4 | 0.051 | 1.20 | 0.0024 | 0.084 | 0.010 | 0.015 | 0.0003 | 0.0029 | | | 878 | Comp. ex. |
| 30 | 0.37 | 0.21 | 1.4 | 0.047 | 0.46 | 0.0002 | 0.087 | 0.011 | 0.013 | 0.0006 | 0.0029 | | | 871 | Comp. ex. |

TABLE 1-2

| Steel | Composition/mass % | | | | | | | | | | | | | A3 | |
|---|---|---|---|---|---|---|---|---|---|---|---|---|---|---|---|
| no. | C | Si | Mil | sol. Al | Cr | B | Nb | Mo | P | S | N | Ti | Ni | (° C.) | Remarks |
| 31 | 0.36 | 0.18 | 1.4 | 0.050 | 0.44 | 0.0005 | 0.087 | 0.012 | 0.013 | 0.0006 | 0.0030 | | | 871 | Inv. ex. |
| 32 | 0.36 | 0.18 | 1.4 | 0.050 | 0.49 | 0.0024 | 0.088 | 0.010 | 0.012 | 0.0005 | 0.0029 | | | 872 | Inv. ex. |
| 33 | 0.36 | 0.19 | 1.4 | 0.048 | 0.47 | 0.0080 | 0.085 | 0.013 | 0.015 | 0.0006 | 0.0031 | | | 871 | Inv. ex. |
| 34 | 0.36 | 0.19 | 1.5 | 0.052 | 0.43 | 0.0140 | 0.086 | 0.010 | 0.014 | 0.0006 | 0.0032 | | | 871 | Comp. ex. |
| 35 | 0.38 | 0.18 | 1.5 | 0.051 | 0.49 | 0.0024 | 0.008 | 0.013 | 0.011 | 0.0005 | 0.0031 | | | 845 | Comp. ex. |
| 36 | 0.36 | 0.20 | 1.5 | 0.052 | 0.42 | 0.0023 | 0.021 | 0.010 | 0.013 | 0.0006 | 0.0031 | | | 848 | Inv. ex. |
| 37 | 0.37 | 0.19 | 1.4 | 0.045 | 0.47 | 0.0023 | 0.084 | 0.010 | 0.012 | 0.0006 | 0.0030 | | | 870 | Inv. ex. |
| 38 | 0.36 | 0.21 | 1.5 | 0.046 | 0.45 | 0.0022 | 0.14 | 0.013 | 0.014 | 0.0006 | 0.0030 | | | 890 | Inv. ex. |
| 39 | 0.36 | 0.21 | 1.4 | 0.051 | 0.44 | 0.0022 | 0.18 | 0.012 | 0.011 | 0.0006 | 0.0031 | | | 904 | Comp. ex. |
| 40 | 0.38 | 0.19 | 1.4 | 0.052 | 0.48 | 0.0025 | 0.087 | 0.002 | 0.014 | 0.0006 | 0.0029 | | | 871 | Comp. ex. |
| 41 | 0.37 | 0.20 | 1.5 | 0.044 | 0.50 | 0.0024 | 0.084 | 0.015 | 0.013 | 0.0005 | 0.0030 | | | 872 | Inv. ex. |
| 42 | 0.38 | 0.18 | 1.5 | 0.050 | 0.46 | 0.0023 | 0.087 | 0.010 | 0.012 | 0.0006 | 0.0030 | | | 872 | Inv. ex. |
| 43 | 0.38 | 0.20 | 1.5 | 0.052 | 0.47 | 0.0023 | 0.088 | 0.82 | 0.013 | 0.0006 | 0.0032 | | | 953 | Inv. ex. |
| 44 | 0.37 | 0.19 | 1.5 | 0.044 | 0.46 | 0.0022 | 0.085 | 1.24 | 0.015 | 0.0005 | 0.0031 | | | 994 | Comp. ex. |
| 45 | 0.38 | 0.20 | 1.4 | 0.047 | 0.44 | 0.0022 | 0.085 | 0.010 | 0.011 | 0.0006 | 0.0031 | | | 871 | Inv. ex. |
| 46 | 0.36 | 0.18 | 1.4 | 0.047 | 0.44 | 0.0022 | 0.084 | 0.010 | 0.130 | 0.0003 | 0.0029 | | | 870 | Comp. ex. |
| 47 | 0.38 | 0.17 | 1.4 | 0.051 | 0.49 | 0.0022 | 0.087 | 0.011 | 0.011 | 0.0003 | 0.0030 | | | 872 | Inv. ex. |
| 48 | 0.38 | 0.19 | 1.5 | 0.048 | 0.46 | 0.0024 | 0.087 | 0.011 | 0.013 | 0.12 | 0.0030 | | | 872 | Comp. ex. |
| 49 | 0.37 | 0.19 | 1.5 | 0.045 | 0.43 | 0.0024 | 0.087 | 0.013 | 0.014 | 0.0004 | 0.0030 | | | 872 | Inv. ex. |
| 50 | 0.36 | 0.20 | 1.4 | 0.049 | 0.42 | 0.0022 | 0.084 | 0.011 | 0.014 | 0.0006 | 0.025 | | | 870 | Comp. ex. |
| 51 | 0.37 | 0.19 | 1.5 | 0.045 | 0.48 | 0.0022 | 0.085 | 0.011 | 0.013 | 0.0004 | 0.0032 | 0.082 | | 892 | Inv. ex. |
| 52 | 0.36 | 0.19 | 1.5 | 0.047 | 0.49 | 0.0024 | 0.088 | 0.010 | 0.014 | 0.0006 | 0.0029 | | 0.2 | 872 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |

TABLE 1-3

| Steel | Composition/mass % | | | | | | | | | | | | | A3 | |
|---|---|---|---|---|---|---|---|---|---|---|---|---|---|---|---|
| no. | C | Si | Mil | sol. Al | Cr | B | Nb | Mo | P | S | N | Ti | Ni | (° C.) | Remarks |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Comp. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |
| 7 | 0.37 | 0.23 | 1.4 | 0.048 | 0.23 | 0.0018 | 0.019 | 0.017 | 0.012 | 0.0018 | 0.0034 | 0.023 | | 852 | Inv. ex. |

I Table 2-1

| | | Continuous casting step | Hot rolling step | | | | | | Plating | | |
|---|---|---|---|---|---|---|---|---|---|---|---|
| Steel no. | Man. no. | Amount of casting of molten steel (ton/min) | Finish rolling temp. (° C.) | Finish rolling rate (%) | Cooling start time (s) | Cooling rate (° C./s) | Coiling start temp. (° C.) | Cold rolling Cold rolling reduction (%) | Plating | Plating, then alloying | Remarks |
| 1 | 1 | 4.4 | 910 | 15 | 0.9 | 115 | 510 | 54 | None | None | Comp. ex. |
| 2 | 2 | 7.9 | 858 | 14 | 0.9 | 121 | 453 | 67 | None | None | Comp. ex. |
| 3 | 3 | 7.9 | 896 | 16 | 0.8 | 116 | 552 | 54 | None | None | Comp. ex. |
| 4 | 4 | 7.2 | 904 | 14 | 0.8 | 115 | 475 | 55 | None | None | Comp. ex. |
| 5 | 5 | 7.9 | 898 | 17 | 0.8 | 198 | 625 | 55 | None | None | Comp. ex. |
| 6 | 6 | 4.3 | 910 | 15 | 0.9 | 123 | 474 | 56 | None | None | Comp. ex. |
| 7 | 7 | 4.1 | 908 | 17 | 0.9 | 121 | 469 | 54 | None | None | Inv. ex. |
| 8 | 8 | 4.0 | 901 | 17 | 0.8 | 117 | 465 | 55 | None | None | Inv. ex. |
| 9 | 9 | 4.2 | 910 | 17 | 0.9 | 120 | 468 | 56 | None | None | Comp. ex. |
| 10 | 10 | 4.2 | 902 | 16 | 0.8 | 117 | 468 | 57 | None | None | Comp. ex. |
| 11 | 11 | 4.2 | 906 | 15 | 0.9 | 123 | 472 | 54 | None | None | Inv. ex. |
| 12 | 12 | 4.4 | 910 | 16 | 0.9 | 122 | 471 | 55 | None | None | Inv. ex. |
| 13 | 13 | 4.3 | 899 | 14 | 0.9 | 119 | 464 | 57 | None | None | Inv. ex. |
| 14 | 14 | 4.2 | 905 | 16 | 0.8 | 125 | 466 | 54 | None | None | Comp. ex. |
| 15 | 15 | 4.1 | 895 | 14 | 0.9 | 119 | 462 | 54 | None | None | Comp. ex. |
| 16 | 16 | 4.0 | 907 | 16 | 0.9 | 125 | 472 | 58 | None | None | Inv. ex. |
| 17 | 17 | 4.3 | 902 | 14 | 0.9 | 115 | 473 | 56 | None | None | Inv. ex. |
| 18 | 18 | 4.3 | 903 | 15 | 0.9 | 115 | 475 | 55 | None | None | Inv. ex. |
| 19 | 19 | 4.1 | 897 | 16 | 0.8 | 122 | 460 | 58 | None | None | Comp. ex. |
| 20 | 20 | 4.3 | 905 | 17 | 0.9 | 117 | 465 | 57 | None | None | Comp. ex. |
| 21 | 21 | 4.1 | 903 | 17 | 0.7 | 117 | 474 | 57 | None | None | Inv. ex. |
| 22 | 22 | 4.2 | 899 | 15 | 0.8 | 118 | 473 | 57 | None | None | Inv. ex. |
| 23 | 23 | 4.0 | 895 | 17 | 0.7 | 124 | 475 | 54 | None | None | Inv. ex. |
| 24 | 24 | 4.3 | 896 | 15 | 0.7 | 124 | 469 | 57 | None | None | Comp. ex. |
| 25 | 25 | 4.3 | 910 | 14 | 0.8 | 121 | 465 | 55 | None | None | Comp. ex. |
| 26 | 26 | 4.3 | 910 | 15 | 0.8 | 121 | 464 | 54 | None | None | Inv. ex. |
| 27 | 27 | 4.3 | 907 | 17 | 0.7 | 117 | 463 | 55 | None | None | Inv. ex. |
| 28 | 28 | 4.0 | 907 | 15 | 0.7 | 119 | 475 | 56 | None | None | Inv. ex. |
| 29 | 29 | 4.0 | 897 | 15 | 0.7 | 119 | 467 | 55 | None | None | Comp. ex. |
| 30 | 30 | 4.3 | 896 | 16 | 0.7 | 116 | 469 | 57 | None | None | Comp. ex. |

TABLE 2-2

| Steel no. | Man. no. | Continuous casting step Amount of casting of molten steel (ton/min) | Hot rolling step Finish rolling temp. (° C.) | Finish rolling rate (%) | Cooling start time (s) | Cooling rate (° C./s) | Coiling start temp. (° C.) | Cold rolling Cold rolling reduction (%) | Plating Plating | Plating, then alloying | Remarks |
|---|---|---|---|---|---|---|---|---|---|---|---|
| 31 | 31 | 3.9 | 896 | 14 | 0.7 | 115 | 469 | 56 | None | None | Inv. ex. |
| 32 | 32 | 3.9 | 909 | 15 | 0.8 | 119 | 463 | 54 | None | None | Inv. ex. |
| 33 | 33 | 4.0 | 905 | 15 | 0.9 | 125 | 472 | 58 | None | None | Inv. ex. |
| 34 | 34 | 4.2 | 907 | 16 | 0.8 | 118 | 466 | 58 | None | None | Comp. ex. |
| 35 | 35 | 3.9 | 897 | 17 | 0.9 | 125 | 471 | 56 | None | None | Comp. ex. |
| 36 | 36 | 4.4 | 908 | 16 | 0.7 | 121 | 465 | 58 | None | None | Inv. ex. |
| 37 | 37 | 3.9 | 910 | 17 | 0.7 | 117 | 469 | 56 | None | None | Inv. ex. |
| 38 | 38 | 4.0 | 909 | 17 | 0.9 | 122 | 474 | 58 | None | None | Inv. ex. |
| 39 | 39 | 4.4 | 949 | 15 | 0.7 | 122 | 472 | 58 | None | None | Comp. ex. |
| 40 | 40 | 4.3 | 899 | 17 | 0.8 | 124 | 470 | 57 | None | None | Comp. ex. |
| 41 | 41 | 3.9 | 906 | 14 | 0.7 | 121 | 466 | 58 | None | None | Inv. ex. |
| 42 | 42 | 4.1 | 895 | 17 | 0.9 | 124 | 464 | 58 | None | None | Inv. ex. |
| 43 | 43 | 4.4 | 965 | 15 | 0.9 | 117 | 470 | 54 | None | None | Inv. ex. |
| 44 | 44 | 3.9 | 1005 | 14 | 0.9 | 124 | 468 | 56 | None | None | Comp. ex. |
| 45 | 45 | 4.4 | 902 | 16 | 0.9 | 118 | 465 | 54 | None | None | Inv. ex. |
| 46 | 46 | 4.3 | 906 | 16 | 0.8 | 119 | 468 | 55 | None | None | Comp. ex. |
| 47 | 47 | 4.0 | 898 | 15 | 0.8 | 121 | 469 | 58 | None | None | Inv. ex. |
| 48 | 48 | 4.3 | 905 | 15 | 0.9 | 121 | 471 | 55 | None | None | Comp. ex. |
| 49 | 49 | 3.9 | 905 | 14 | 0.9 | 119 | 467 | 55 | None | None | Inv. ex. |
| 50 | 50 | 4.0 | 910 | 15 | 0.7 | 121 | 468 | 55 | None | None | Comp. ex. |
| 51 | 51 | 4.3 | 904 | 14 | 0.9 | 115 | 460 | 57 | None | None | Inv. ex. |
| 52 | 52 | 3.9 | 898 | 15 | 0.9 | 117 | 470 | 57 | None | None | Inv. ex. |
| 7 | 53 | 3.0 | 903 | 15 | 0.9 | 117 | 460 | 55 | None | None | Inv. ex. |
| 7 | 54 | 5.0 | 896 | 15 | 0.7 | 124 | 471 | 54 | None | None | Inv. ex. |
| 7 | 55 | 8.4 | 910 | 16 | 0.9 | 121 | 471 | 56 | None | None | Comp. ex. |
| 7 | 56 | 3.9 | 881 | 14 | 0.8 | 123 | 468 | 57 | None | None | Comp. ex. |
| 7 | 57 | 4.2 | 898 | 15 | 0.9 | 119 | 463 | 55 | None | None | Inv. ex. |

[Table 2-3

| Steel no. | Man. no. | Continuous casting step Amount of casting of molten steel (ton/min) | Hot rolling step Finish rolling temp. (° C.) | Finish rolling rate (%) | Cooling start time (s) | Cooling rate (° C./s) | Coiling start temp. (° C.) | Cold rolling Cold rolling reduction (%) | Plating Plating | Plating, then alloying | Remarks |
|---|---|---|---|---|---|---|---|---|---|---|---|
| 7 | 58 | 4.0 | 905 | 16 | 0.7 | 115 | 469 | 57 | None | None | Inv. ex. |
| 7 | 59 | 4.1 | 999 | 16 | 0.8 | 120 | 461 | 57 | None | None | Inv. ex. |
| 7 | 60 | 4.2 | 1145 | 16 | 0.9 | 117 | 462 | 58 | None | None | Comp. ex. |
| 7 | 61 | 4.2 | 905 | 9 | 0.7 | 123 | 463 | 56 | None | None | Comp. ex. |
| 7 | 62 | 4.2 | 906 | 12 | 0.9 | 119 | 473 | 57 | None | None | Inv. ex. |
| 7 | 63 | 4.0 | 909 | 17 | 0.7 | 120 | 473 | 54 | None | None | Inv. ex. |
| 7 | 64 | 4.0 | 903 | 16 | 0.9 | 125 | 475 | 55 | None | None | Inv. ex. |
| 7 | 65 | 4.1 | 895 | 16 | 0.8 | 122 | 465 | 54 | None | None | Inv. ex. |
| 7 | 66 | 3.9 | 908 | 17 | 2.0 | 125 | 467 | 57 | None | None | Comp. ex. |
| 7 | 67 | 4.0 | 896 | 14 | 0.9 | 88 | 472 | 57 | None | None | Comp. ex. |
| 7 | 68 | 4.2 | 899 | 14 | 0.8 | 110 | 463 | 55 | None | None | Inv. ex. |
| 7 | 69 | 4.1 | 896 | 16 | 0.9 | 119 | 471 | 57 | None | None | Inv. ex. |
| 7 | 70 | 4.0 | 908 | 16 | 0.7 | 117 | 56 | 56 | None | None | Inv. ex. |
| 7 | 71 | 3.9 | 909 | 17 | 0.9 | 117 | 467 | 58 | None | None | Inv. ex. |
| 7 | 72 | 4.2 | 897 | 17 | 0.9 | 120 | 480 | 54 | None | None | Inv. ex. |
| 7 | 73 | 4.1 | 898 | 15 | 0.7 | 125 | 543 | 56 | None | None | Comp. ex. |
| 7 | 74 | 4.3 | 901 | 16 | 0.7 | 123 | 469 | 0 | None | None | Inv. ex. |
| 7 | 75 | 3.9 | 898 | 14 | 0.7 | 119 | 464 | 57 | Yes | None | Inv. ex. |
| 7 | 76 | 4.1 | 898 | 14 | 0.7 | 121 | 463 | 54 | Yes | Yes | Inv. ex. |
| 7 | 77 | 4.1 | 895 | 15 | 0.9 | 123 | 467 | 55 | None | None | Inv. ex. |
| 7 | 78 | 4.1 | 910 | 16 | 0.9 | 121 | 467 | 54 | None | None | Inv. ex. |
| 7 | 79 | 4.1 | 905 | 14 | 0.8 | 124 | 460 | 56 | None | None | Inv. ex. |
| 7 | 80 | 3.9 | 903 | 14 | 0.9 | 120 | 470 | 57 | None | None | Inv. ex. |
| 7 | 81 | 4.3 | 898 | 16 | 0.8 | 117 | 469 | 55 | None | None | Comp. ex. |
| 7 | 82 | 4.1 | 904 | 14 | 0.8 | 118 | 462 | 58 | None | None | Inv. ex. |
| 7 | 83 | 3.9 | 908 | 17 | 0.7 | 118 | 460 | 54 | None | None | Inv. ex. |
| 7 | 58 | 4.0 | 905 | 16 | 0.7 | 115 | 469 | 57 | None | None | Inv. ex. |

TABLE 3-1

| | | Hot stamping step | | | | Microstructure of hot stamped article | | | Mechanical properties of hot stamped article | | |
|---|---|---|---|---|---|---|---|---|---|---|---|
| Steel no. | Man. no. | Heating rate (° C./s) | Heating temp. (° C.) | Cooling rate (° C.) | Tempering temp. (° C.) | *1 | Type of structure | *2 | Max. strength (MPa) | Max. bending angle (°) | Remarks |
| 1 | 1 | 162 | 916 | 57 | | 95 | Martensite | 63 | 1923 | 35 | Comp. ex. |
| 2 | 2 | 87 | 862 | 62 | | 100 | Martensite | 65 | 1665 | 68 | Comp. ex. |
| 3 | 3 | 20 | 898 | 49 | | 100 | Martensite | 67 | 1750 | 64 | Comp. ex. |
| 4 | 4 | 178 | 911 | 50 | | 100 | Martensite | 65 | 1973 | 47 | Comp. ex. |
| 5 | 5 | 161 | 909 | 46 | | 100 | Martensite | 67 | 1158 | 88 | Comp. ex. |
| 6 | 6 | 71 | 918 | 47 | | 61 | Martensite | 81 | 1378 | 78 | Comp. ex. |
| 7 | 7 | 52 | 908 | 59 | | 93 | Martensite | 88 | 2056 | 67 | Inv. ex. |
| 8 | 8 | 69 | 913 | 51 | | 95 | Martensite | 89 | 2541 | 68 | Inv. ex. |
| 9 | 9 | 67 | 918 | 57 | | 96 | Martensite | 91 | 1522 | 41 | Comp. ex. |
| 10 | 10 | 64 | 909 | 52 | | 97 | Martensite | 82 | 1598 | 43 | Comp. ex. |
| 11 | 11 | 53 | 906 | 49 | | 97 | Martensite | 84 | 2128 | 57 | Inv. ex. |
| 12 | 12 | 41 | 919 | 59 | | 96 | Martensite | 87 | 2261 | 65 | Inv. ex. |
| 13 | 13 | 55 | 909 | 62 | | 97 | Martensite | 83 | 2019 | 60 | Inv. ex. |
| 14 | 14 | 78 | 908 | 54 | | 95 | Martensite | 73 | 1538 | 40 | Comp. ex. |
| 15 | 15 | 74 | 900 | 53 | | 64 | Martensite | 86 | 1520 | 77 | Comp. ex. |
| 16 | 16 | 46 | 908 | 59 | | 97 | Martensite | 87 | 2100 | 61 | Inv. ex. |
| 17 | 17 | 55 | 907 | 51 | | 98 | Martensite | 84 | 2226 | 65 | Inv. ex. |
| 18 | 18 | 48 | 913 | 59 | | 99 | Martensite | 84 | 2072 | 59 | Inv. ex. |
| 19 | 19 | 48 | 904 | 58 | | 95 | Martensite | 70 | 1783 | 44 | Comp. ex. |
| 20 | 20 | 47 | 912 | 60 | | 98 | Martensite | 88 | 1644 | 43 | Comp. ex. |
| 21 | 21 | 46 | 909 | 54 | | 94 | Martensite | 85 | 2121 | 69 | Inv. ex. |
| 22 | 22 | 80 | 905 | 46 | | 97 | Martensite | 88 | 2262 | 68 | Inv. ex. |
| 23 | 23 | 47 | 902 | 56 | | 99 | Martensite | 87 | 2025 | 65 | Inv. ex. |
| 24 | 24 | 63 | 899 | 64 | | 94 | Martensite | 87 | 1611 | 41 | Comp. ex. |
| 25 | 25 | 59 | 920 | 45 | | 61 | Martensite | 84 | 1549 | 71 | Comp. ex. |
| 26 | 26 | 76 | 913 | 49 | | 96 | Martensite | 86 | 2062 | 61 | Inv. ex. |
| 27 | 27 | 78 | 910 | 58 | | 99 | Martensite | 86 | 2251 | 68 | Inv. ex. |
| 28 | 28 | 77 | 908 | 57 | | 94 | Martensite | 84 | 2201 | 62 | Inv. ex. |
| 29 | 29 | 83 | 906 | 55 | | 96 | Martensite | 72 | 1787 | 44 | Comp. ex. |
| 30 | 30 | 42 | 901 | 61 | | 61 | Martensite | 87 | 1502 | 77 | Comp. ex. |

*1 . . . Area rate (%) of lower bainite, martensite, or tempered martensite

*2 . . . Ratio of grain boundaries with rotational angle about rotational axis of <011> direction of crystal grains of martensite of 15° or more in grain boundaries with rotational angle of 5° to 75°

TABLE 3-2

| | | Hot stamping step | | | | Microstructure of hot stamped article | | | Mechanical properties of hot stamped article | | |
|---|---|---|---|---|---|---|---|---|---|---|---|
| Steel no. | Man. no. | Heating rate (° C./s) | Heating temp. (° C.) | Cooling rate (° C.) | Tempering temp. (° C.) | *1 | Type of structure | *2 | Max. strength (MPa) | Max. bending angle (°) | Remarks |
| 31 | 31 | 40 | 905 | 61 | | 95 | Martensite | 84 | 2059 | 69 | Inv. ex. |
| 32 | 32 | 70 | 910 | 49 | | 99 | Martensite | 84 | 2124 | 69 | Inv. ex. |
| 33 | 33 | 36 | 907 | 58 | | 94 | Martensite | 86 | 2006 | 60 | Inv. ex. |
| 34 | 34 | 52 | 909 | 53 | | 96 | Martensite | 73 | 1611 | 40 | Comp. ex. |
| 35 | 35 | 35 | 903 | 47 | | 96 | Martensite | 69 | 1705 | 40 | Comp. ex. |
| 36 | 36 | 72 | 910 | 62 | | 97 | Martensite | 82 | 2106 | 57 | Inv. ex. |
| 37 | 37 | 71 | 921 | 48 | | 97 | Martensite | 88 | 2302 | 66 | Inv. ex. |
| 38 | 38 | 79 | 914 | 59 | | 99 | Martensite | 86 | 2113 | 63 | Inv. ex. |
| 39 | 39 | 83 | 955 | 48 | | 96 | Martensite | 70 | 1705 | 36 | Comp. ex. |
| 40 | 40 | 78 | 901 | 64 | | 97 | Martensite | 71 | 1720 | 40 | Comp. ex. |
| 41 | 41 | 43 | 907 | 53 | | 95 | Martensite | 82 | 2001 | 59 | Inv. ex. |
| 42 | 42 | 64 | 901 | 61 | | 98 | Martensite | 85 | 2232 | 63 | Inv. ex. |
| 43 | 43 | 44 | 970 | 45 | | 96 | Martensite | 82 | 2042 | 61 | Inv. ex. |
| 44 | 44 | 64 | 1004 | 59 | | 97 | Martensite | 72 | 1686 | 36 | Comp. ex. |
| 45 | 45 | 47 | 913 | 55 | | 96 | Martensite | 87 | 2088 | 61 | Inv. ex. |
| 46 | 46 | 66 | 907 | 49 | | 97 | Martensite | 84 | 1593 | 41 | Comp. ex. |
| 47 | 47 | 65 | 897 | 48 | | 95 | Martensite | 86 | 2168 | 64 | Inv. ex. |
| 48 | 48 | 62 | 910 | 55 | | 97 | Martensite | 85 | 1572 | 44 | Comp. ex. |
| 49 | 49 | 51 | 915 | 56 | | 97 | Martensite | 85 | 2210 | 64 | Inv. ex. |
| 50 | 50 | 41 | 911 | 62 | | 97 | Martensite | 87 | 1639 | 43 | Comp. ex. |
| 51 | 51 | 69 | 912 | 61 | | 98 | Martensite | 87 | 2352 | 63 | Inv. ex. |
| 52 | 52 | 37 | 902 | 64 | | 98 | Martensite | 86 | 2140 | 61 | Inv. ex. |
| 7 | 53 | 47 | 909 | 61 | | 98 | Martensite | 84 | 2169 | 68 | Inv. ex. |
| 7 | 54 | 85 | 901 | 63 | | 95 | Martensite | 86 | 2373 | 64 | Inv. ex. |
| 7 | 55 | 38 | 915 | 46 | | 96 | Martensite | 71 | 1592 | 39 | Comp. ex. |

TABLE 3-2-continued

| | | Hot stamping step | | | | Microstructure of hot stamped article | | | Mechanical properties of hot stamped article | | |
|---|---|---|---|---|---|---|---|---|---|---|---|
| Steel no. | Man. no. | Heating rate (° C./s) | Heating temp. (° C.) | Cooling rate (° C.) | Tempering temp. (° C.) | *1 | Type of structure | *2 | Max. strength (MPa) | Max. bending angle (°) | Remarks |
| 7 | 56 | 62 | 887 | 48 | | 95 | Martensite | 72 | 1515 | 40 | Comp. ex. |
| 7 | 57 | 73 | 909 | 55 | | 96 | Martensite | 83 | 2080 | 59 | Inv. ex. |

*1 . . . Area rate (%) of lower bainite, martensite, or tempered martensite

*2 . . . Ratio of grain boundaries with rotational angle about rotational axis of <011> direction of crystal grains of martensite of 15° or more in grain boundaries with rotational angle of 5° to 75°

TABLE 3-3

| | | Hot stamping step | | | | Microstructure of hot stamped article | | | Mechanical properties of hot stamped article | | |
|---|---|---|---|---|---|---|---|---|---|---|---|
| Steel no. | Man. no. | Heating rate (° C./s) | Heating temp. (° C.) | Cooling rate (° C.) | Tempering temp. (° C.) | *1 | Type of structure | *2 | Max. strength (MPa) | Max. bending angle (°) | Remarks |
| 7 | 58 | 52 | 910 | 55 | | 98 | Martensite | 85 | 2197 | 67 | Inv. ex. |
| 7 | 59 | 59 | 1005 | 63 | | 97 | Martensite | 81 | 2043 | 57 | Inv. ex. |
| 7 | 60 | 76 | 1156 | 49 | | 97 | Martensite | 83 | 1790 | 56 | Comp. ex. |
| 7 | 61 | 77 | 913 | 65 | | 96 | Martensite | 70 | 1761 | 44 | Comp. ex. |
| 7 | 62 | 71 | 914 | 46 | | 96 | Martensite | 82 | 2142 | 59 | Inv. ex. |
| 7 | 63 | 58 | 918 | 64 | | 97 | Martensite | 85 | 2217 | 66 | Inv. ex. |
| 7 | 64 | 52 | 909 | 50 | | 96 | Martensite | 86 | 2154 | 66 | Inv. ex. |
| 7 | 65 | 82 | 897 | 53 | | 95 | Martensite | 83 | 2197 | 63 | Inv. ex. |
| 7 | 66 | 75 | 914 | 62 | | 96 | Martensite | 73 | 1602 | 39 | Comp. ex. |
| 7 | 67 | 49 | 901 | 49 | | 95 | Martensite | 73 | 1633 | 38 | Comp. ex. |
| 7 | 68 | 74 | 907 | 60 | | 96 | Martensite | 81 | 2143 | 60 | Inv. ex. |
| 7 | 69 | 83 | 898 | 63 | | 95 | Martensite | 84 | 2217 | 68 | Inv. ex. |
| 7 | 70 | 65 | 907 | 57 | | 95 | Martensite | 90 | 2259 | 77 | Inv. ex. |
| 7 | 71 | 56 | 911 | 47 | | 96 | Martensite | 87 | 2085 | 66 | Inv. ex. |
| 7 | 72 | 38 | 898 | 59 | | 95 | Martensite | 81 | 2034 | 59 | Inv. ex. |
| 7 | 73 | 77 | 909 | 59 | | 99 | Martensite | 73 | 1587 | 36 | Comp. ex. |
| 7 | 74 | 71 | 905 | 51 | | 97 | Martensite | 88 | 2252 | 68 | Inv. ex. |
| 7 | 75 | 55 | 907 | 58 | | 94 | Martensite | 88 | 2004 | 61 | Inv. ex. |
| 7 | 76 | 46 | 903 | 54 | | 98 | Martensite | 85 | 2165 | 58 | Inv. ex. |
| 7 | 77 | 40 | 898 | 64 | 175 | 97 | Tempered martensite | 87 | 2059 | 62 | Inv. ex. |
| 7 | 78 | 40 | 921 | 46 | | 97 | Martensite | 81 | 2094 | 62 | Inv. ex. |
| 7 | 79 | 64 | 909 | 54 | | 96 | Martensite | 84 | 2148 | 64 | Inv. ex. |
| 7 | 80 | 40 | 910 | 62 | | 97 | Martensite | 82 | 2117 | 57 | Inv. ex. |
| 7 | 81 | 148 | 906 | 58 | | 96 | Martensite | 69 | 2175 | 41 | Comp. ex. |
| 7 | 82 | 79 | 913 | 53 | | 95 | Martensite | 87 | 2156 | 63 | Inv. ex. |
| 7 | 83 | 69 | 911 | 58 | | 97 | Martensite | 84 | 2216 | 63 | Inv. ex. |

*1 . . . Area rate (%) of lower bainite, martensite, or tempered martensite

*2 . . . Ratio of grain boundaries with rotational angle about rotational axis of <011> direction of crystal grains of martensite of 15° or more in grain boundaries with rotational angle of 5° to 75°

In the hot stamped article, the above-mentioned method was used to measure the area ratios of the lower bainite, martensite, and tempered martensite and the ratio of grain boundaries with rotational angle about rotational axis of <011> direction of crystal grains of martensite of 15° or more in grain boundaries with rotational angle of 5° to 75°.

The strength of the hot stamped article was evaluated by performing a tensile test. The tensile test was performed by preparing a No. 5 test piece described in JIS Z 2201 and following the test method described in JIS Z 2241. A maximum strength of 2000 MPa or more was deemed as passing.

The bending deformability was evaluated based on the VDA standard (VDA238-100) prescribed by the German Association of the Automotive Industry. In the present invention, the displacement at the time of maximum load obtained in a bending test was converted to angle in the VDA standard, the maximum bending angle was found, and a material with a maximum bending angle of 50° or more was deemed as passing.

Test piece dimensions: 60 mm (rolling direction)×30 mm (direction vertical to rolling) or 30 mm (rolling direction)×60 mm (direction vertical to rolling), sheet thickness 1.0 mm Bending ridgeline: direction perpendicular to rolling Test method: roll support, punch pressing Roll diameter: φ30 mm Punch shape: tip R=0.4 mm Distance between rolls: 2.0×1.0 (mm)+0.5 mm Pressing rate: 20 mm/min Tester: SHIMAZU AUTOGRAPH 20 kN The hot stamped article of the present invention could be confirmed to have a tensile strength of 2000 MPa or more and an excellent bending deformability. On the other hand, in examples where the chemical compositions and methods of manufacture were not suitable, the targeted properties could not be obtained.

The invention claimed is:

1. A hot stamped article, having a chemical composition comprising, by mass %, C: 0.35% to 0.75%, Si: 0.005% to 0.25%, Mn: 0.5% to 3.0%, sol. Al: 0.0002% to 3.0%, Cr: 0.05% to 1.00%, B: 0.0005% to 0.010%, Nb: 0.01% to 0.15%, Mo: 0.005% to 1.00%, Ti: 0% to 0.15%, Ni: 0% to 3.00%, P: 0.10% or less, S: 0.10% or less, N: 0.010% or less and a balance of Fe and unavoidable impurities, microstructures in which at least one of lower bainite, martensite, and tempered martensite are contained with an area rate of 90% or more, and when the <011> direction of the crystal grains of the lower bainite, martensite, and tempered martensite is a rotational axis, a ratio of a length of grain boundaries with a rotational angle 15° or more to a length of grain boundaries with a rotational angle of 5° to 75° is 80% or more.

2. A hot stamped article according to claim 1, wherein the hot stamped article comprises a plated layer.

* * * * *